US007032604B2

(12) United States Patent
Welch

(10) Patent No.: US 7,032,604 B2
(45) Date of Patent: Apr. 25, 2006

(54) THREE RACK DISHWASHER

(75) Inventor: Rodney M. Welch, Jackson, TN (US)

(73) Assignee: Maytag Corporation, Newton, IA (US)

( * ) Notice: Subject to any disclaimer, the term of this patent is extended or adjusted under 35 U.S.C. 154(b) by 471 days.

(21) Appl. No.: 10/156,414

(22) Filed: May 28, 2002

(65) Prior Publication Data

US 2003/0226580 A1 Dec. 11, 2003

(51) Int. Cl.
*B08B 3/02* (2006.01)

(52) U.S. Cl. ..... 134/135; 134/200; 211/41.8; 211/41.9

(58) Field of Classification Search ..... 134/56 D, 134/57 D, 57 DL, 137, 144, 176, 179, 147, 134/148, 165, 135; D32/2, 3, 53; 211/41.8, 211/41.9; D6/459, 463
See application file for complete search history.

(56) References Cited

U.S. PATENT DOCUMENTS

| | | | | |
|---|---|---|---|---|
| 1,345,226 | A * | 6/1920 | Paris | 134/158 |
| 1,446,905 | A * | 2/1923 | Kehoe et al. | 134/151 |
| 1,583,657 | A * | 5/1926 | Chapman | 134/176 |
| 1,631,045 | A * | 5/1927 | Macon | 134/175 |
| 1,826,951 | A * | 10/1931 | Patterson | 211/41.8 |
| 1,928,683 | A * | 10/1933 | Cammann, Jr. | 134/175 |
| 2,141,162 | A * | 12/1938 | Brandt | 134/118 |
| 2,153,322 | A * | 4/1939 | Walker | 220/213 |
| 2,622,926 | A * | 12/1952 | Oswald | 239/229 |
| 2,646,809 | A * | 7/1953 | Hise | 134/182 |
| 2,648,588 | A * | 8/1953 | Ruspino | 312/308 |
| 2,664,902 | A * | 1/1954 | Campion | 134/175 |
| 2,681,844 | A * | 6/1954 | Walker | 312/311 |
| 2,710,617 | A * | 6/1955 | Lewis et al. | 134/183 |
| 3,051,184 | A * | 8/1962 | Gibson | 134/183 |
| 3,258,127 | A * | 6/1966 | Cushing | 211/41.8 |

(Continued)

FOREIGN PATENT DOCUMENTS

DE 26 10 379 * 9/1977

(Continued)

OTHER PUBLICATIONS

Whirlpool Corporation, "Dishwasher Shopping Guide" world wide web page available online at http://www.whirlpool.com.au/Beforeibuy/Dishwasher.htm, available as of Mar. 9, 2001.*

(Continued)

*Primary Examiner*—Frankie L. Stinson
(74) *Attorney, Agent, or Firm*—McKee, Voorhees & Sease, P.L.C.

(57) ABSTRACT

An improved dishwasher is provided with a lower rack, a middle rack, and an upper rack. Each rack has a spray arm associated therewith. A fourth spray arm may also be provided for enhanced cleaning of objects in the racks. The lower rack is a low profile tineless rack for holding flat and shallow objects. The middle and upper racks have bottom portions sloping in opposite directions so as to accommodate larger items, such as dinner plates, in each rack. The middle and upper racks are independently vertically adjustable with respect to one another.

29 Claims, 6 Drawing Sheets

U.S. PATENT DOCUMENTS

| | | | | | |
|---|---|---|---|---|---|
| 3,356,097 | A | * | 12/1967 | Schaap | 134/112 |
| 3,486,804 | A | | 12/1969 | Kaufman et al. | |
| 3,594,058 | A | | 7/1971 | Kauffman | |
| 3,759,276 | A | * | 9/1973 | Nolte | 134/57 DL |
| 3,809,106 | A | * | 5/1974 | Crabtree | 134/176 |
| 3,837,917 | A | | 9/1974 | Jenkins et al. | |
| 3,861,769 | A | | 1/1975 | Jenkins | |
| 4,917,248 | A | * | 4/1990 | Friskney | 211/41.8 |
| 5,086,544 | A | * | 2/1992 | Huttemann et al. | 211/41.8 |
| 5,205,419 | A | * | 4/1993 | Purtilo | 211/41.8 |
| 5,979,472 | A | * | 11/1999 | Lowery et al. | 134/58 R |
| 6,622,740 | B1 | * | 9/2003 | Durazzani | 134/201 |
| 6,666,220 | B1 | * | 12/2003 | Spanyer et al. | 134/58 D |
| 2002/0062849 | A1 | * | 5/2002 | Ekelhoff | 134/113 |

FOREIGN PATENT DOCUMENTS

| | | | |
|---|---|---|---|
| DE | 42 27 585 | * | 2/1994 |
| DE | 296 08 871 | * | 10/1997 |
| DE | 199 60 496 | * | 7/2001 |
| EP | 0848 930 A2 | * | 6/1998 |
| FR | 2 821 735 | * | 9/2002 |
| JP | 9-271460 | * | 10/1997 |
| JP | 10-180212 | * | 7/1998 |

OTHER PUBLICATIONS

European Patent Office 0 372 342 Jun. 1990.*

* cited by examiner

THREE RACK DISHWASHER

BACKGROUND OF THE INVENTION

Dishwashers typically have an upper and lower rack for holding objects to be washed. The racks of different manufacturers have numerous configurations to provide various loading arrangements for the objects, such as plates, bowls, glasses, silverware, pots and pans. These conventional two rack dishwashers normally have upper and lower spray arms to deliver water to wash and rinse the objects in the racks.

Dishwashers have also been designed with three racks, such as in U.S. Pat. Nos. 3,837,917, and 3,861,769. However, such three rack dishwashers do not have separate spray arms for each rack, but rather rely upon a telescoping spray tower to supply wash and rinse water to one or more of the racks. Such spray towers are less effective in cleaning than rotating spray arms which have a better spray pattern than a spray tower.

Accordingly, a primary objective of the present invention is the provision of a dishwasher having three racks with separate spray arms for each rack.

Another objective of the present invention is the provision of a dishwasher having three racks, wherein the upper two racks have bottom portions which slope or step in opposite directions so as to maximize loading options and usefulness of the racks.

A further objective of the present invention is the provision of a dishwasher having a flat lower rack without or substantially without tines, and middle and upper racks with tines.

Still another objective of the present invention is the provision of a dishwasher having three racks, with at least the upper two racks being vertically adjustable independent of one another.

These and other objectives will become apparent from the following description of the invention.

SUMMARY OF THE INVENTION

A dishwasher is provided with three racks mounted in the washing chamber for movement between an extended loading position substantially outside of the washing chamber, and a retracted washing position within the washing chamber. Three spray arms are provided in the dishwasher so that there is one spray arm associated with each of the racks. A fourth spray arm may also be provided for enhanced cleaning of the objects in the racks. The middle and upper racks have bottom portions sloped or stepped in opposite directions so as to allow tall objects, such as dinner plates, to be placed in both racks. The bottom rack is flat and without or substantially without tines so as to receive low profile objects, such as cake pans, cookie sheets and frying pans. The middle and upper racks are independently vertically adjustable.

DETAILED DESCRIPTION OF THE INVENTION

Figure 1:
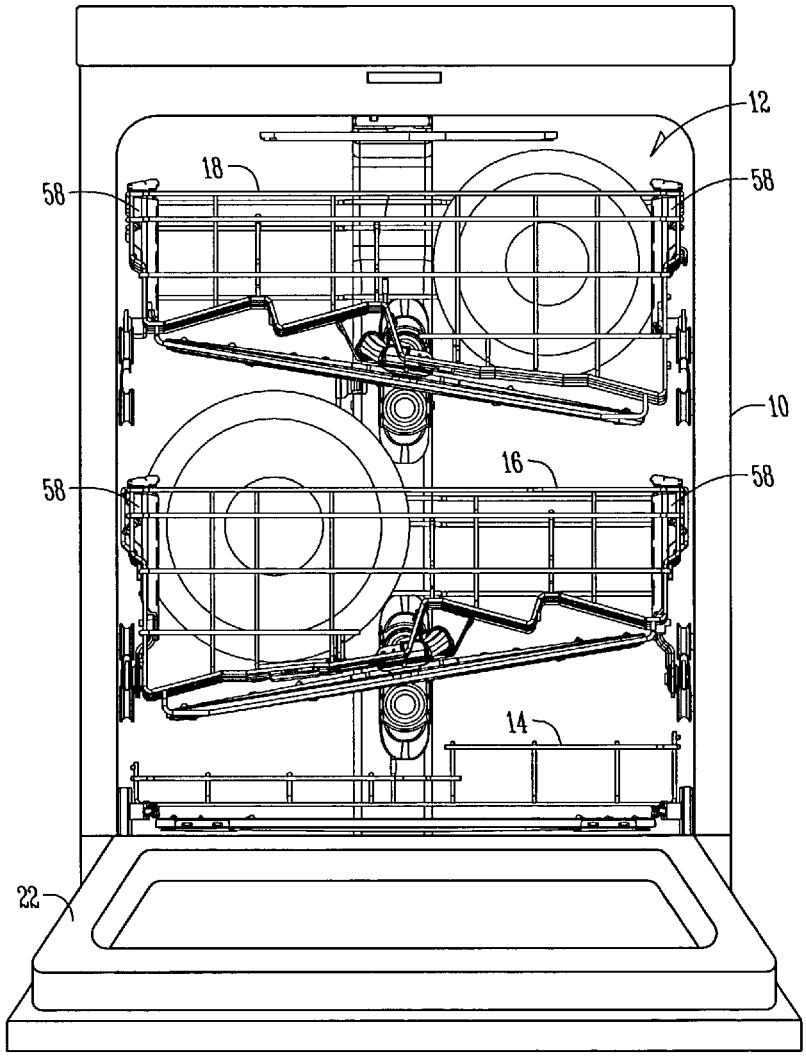
FIG. 1 is a front elevation view showing a dishwasher having the three racks of the present invention.

A dishwasher is generally designated by the reference numeral 10 in the drawings. The dishwasher 10 has a washing chamber 12 in which is mounted a lower rack 14, a middle rack 16 and an upper rack 18. The lower, middle and upper racks, 14, 16, and 18 are adapted to move between an extended position located substantially outside the wash chamber 12 for loading objects to be washed, and a retracted position within the chamber 12 for washing the objects.

More particularly, the lower rack 14 includes rollers 20 adapted to roll upon a lip or ledge formed in the sidewalls of the wash chamber 12 and upon the door 22 of the dishwasher 10 when the door is in the horizontal open position. The middle rack 16 includes rollers 24 adapted to roll along rails 26 mounted to the side walls of the chambers 12. The upper rack includes rollers 28 adapted to roll along rails 30 mounted in the opposite sides of the chamber 12. The rails 26 and 30 may be telescoping so that the middle rack 16 and upper rack 18 can be pulled further out of the wash chamber 12 for loading and unloading.

Figure 2:
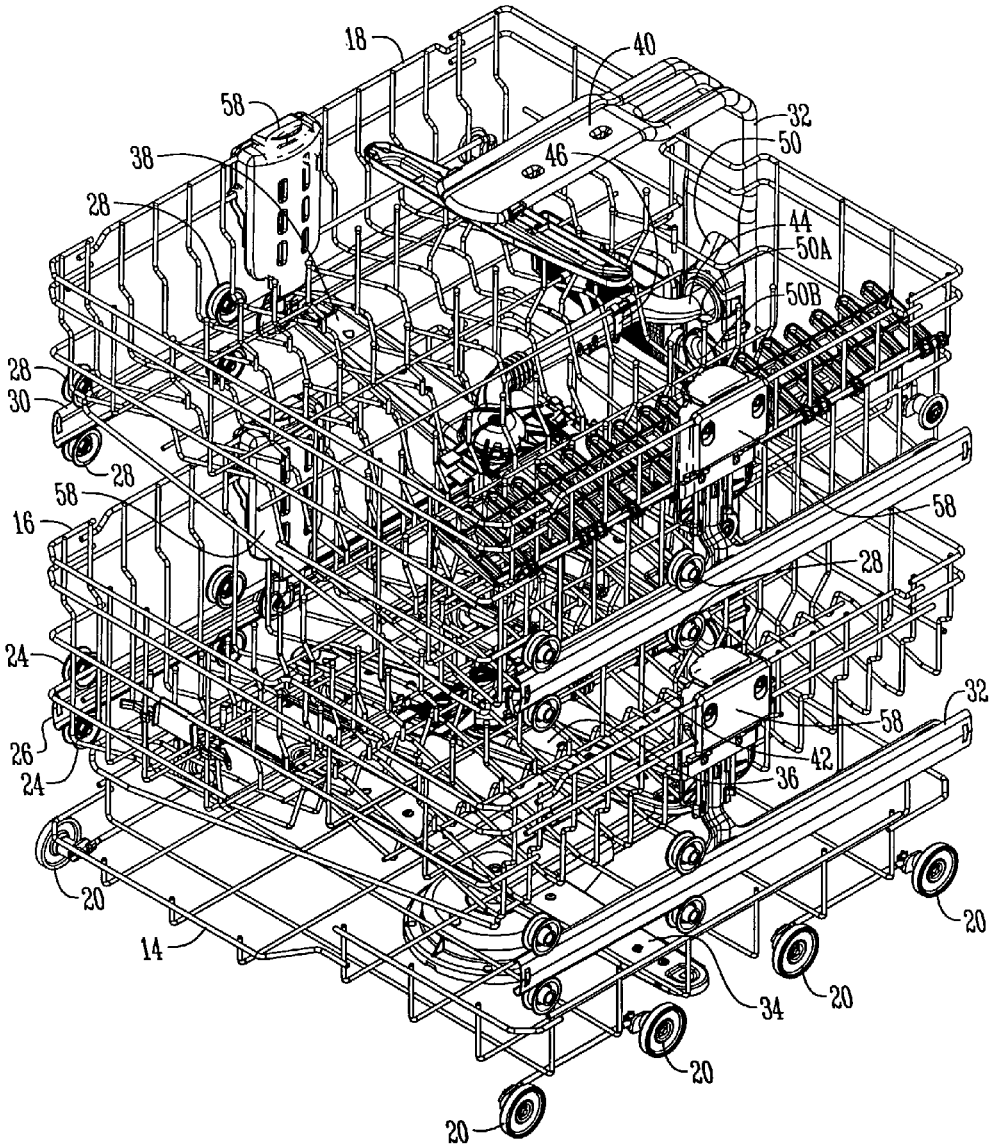
FIG. 2 is a perspective view from the right front corner showing the three racks and the associated spray arms.
Figure 3:
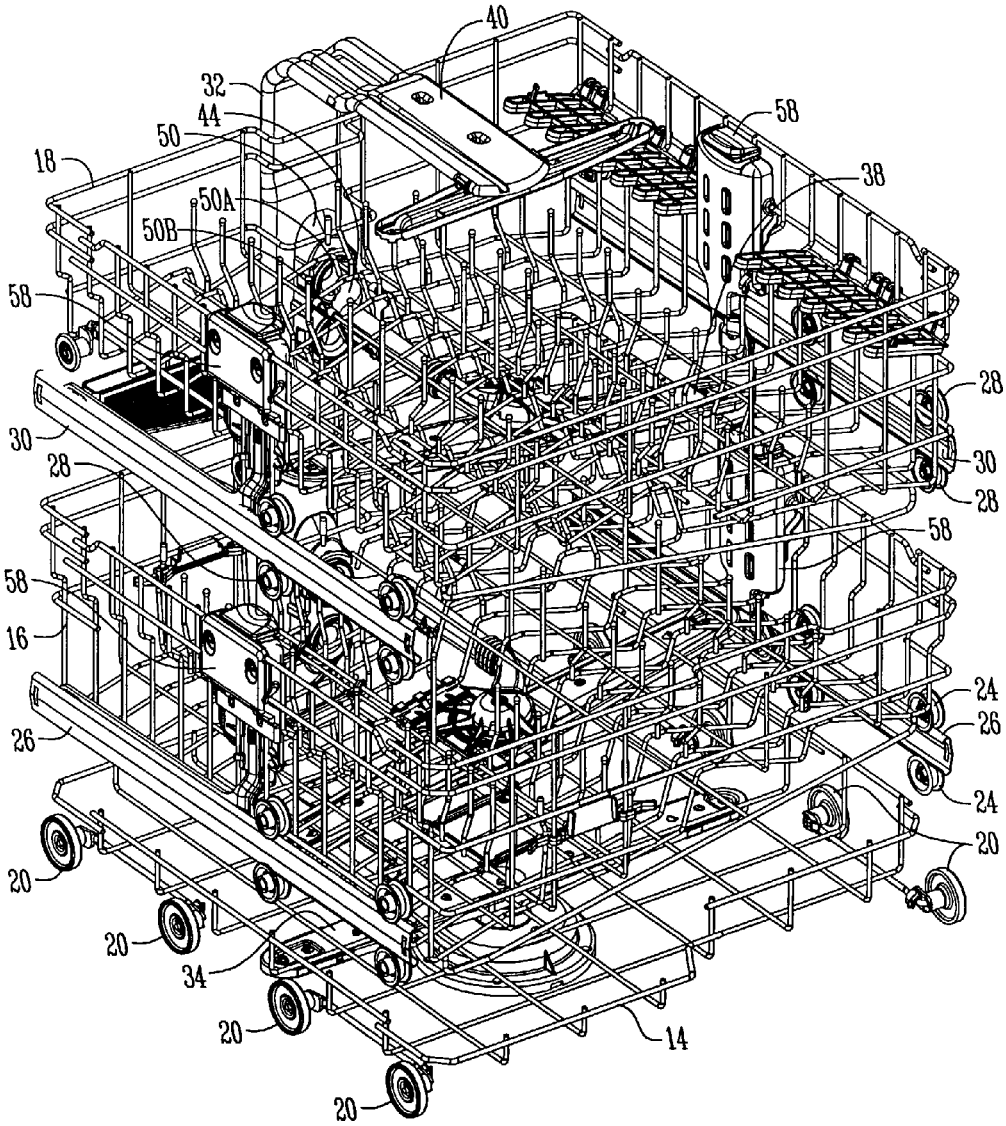
FIG. 3 is a view similar to FIG. 2 from the left front corner.
Figure 5:
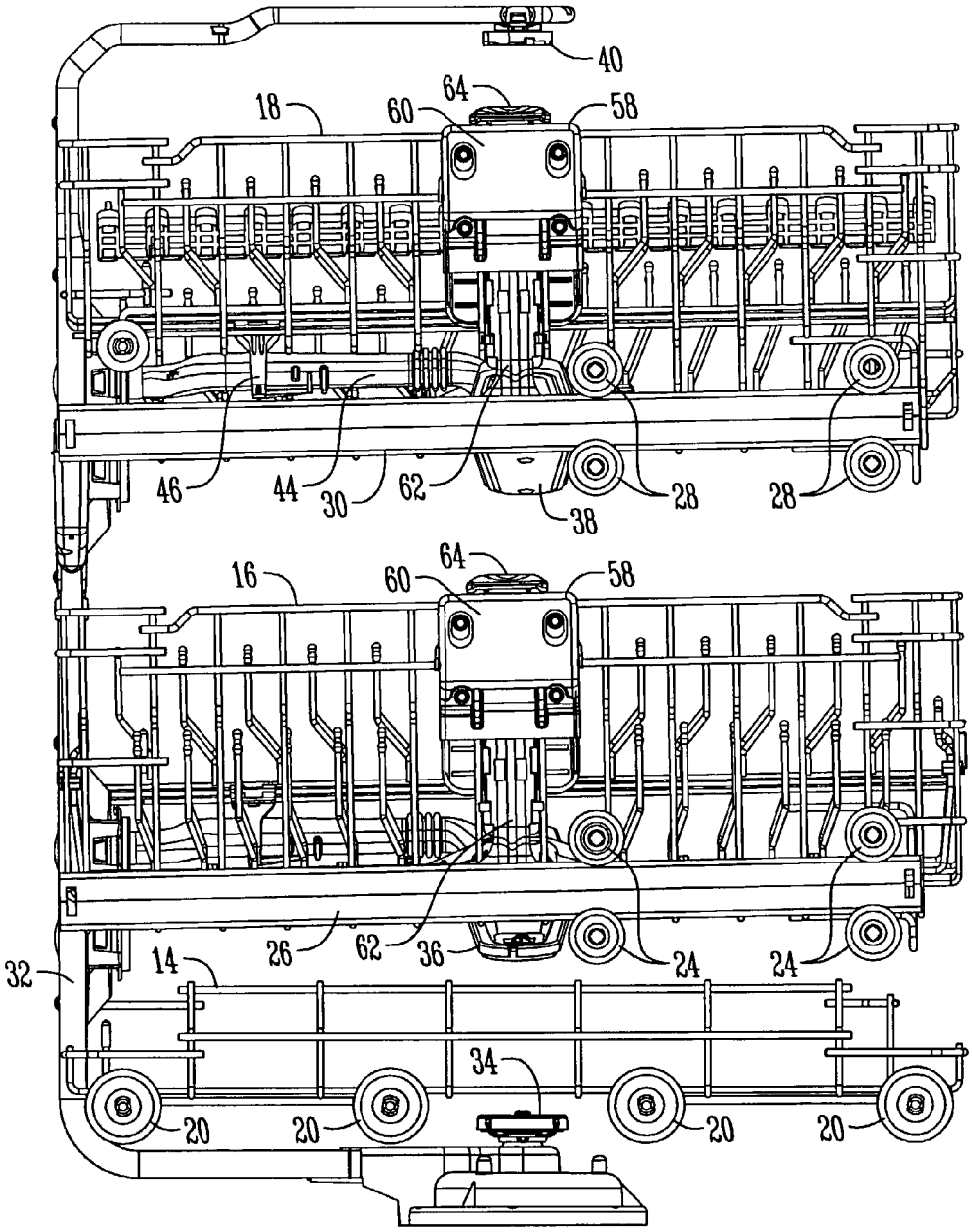
FIG. 5 is a left side elevation view of the racks and spray arms.
Figure 6:
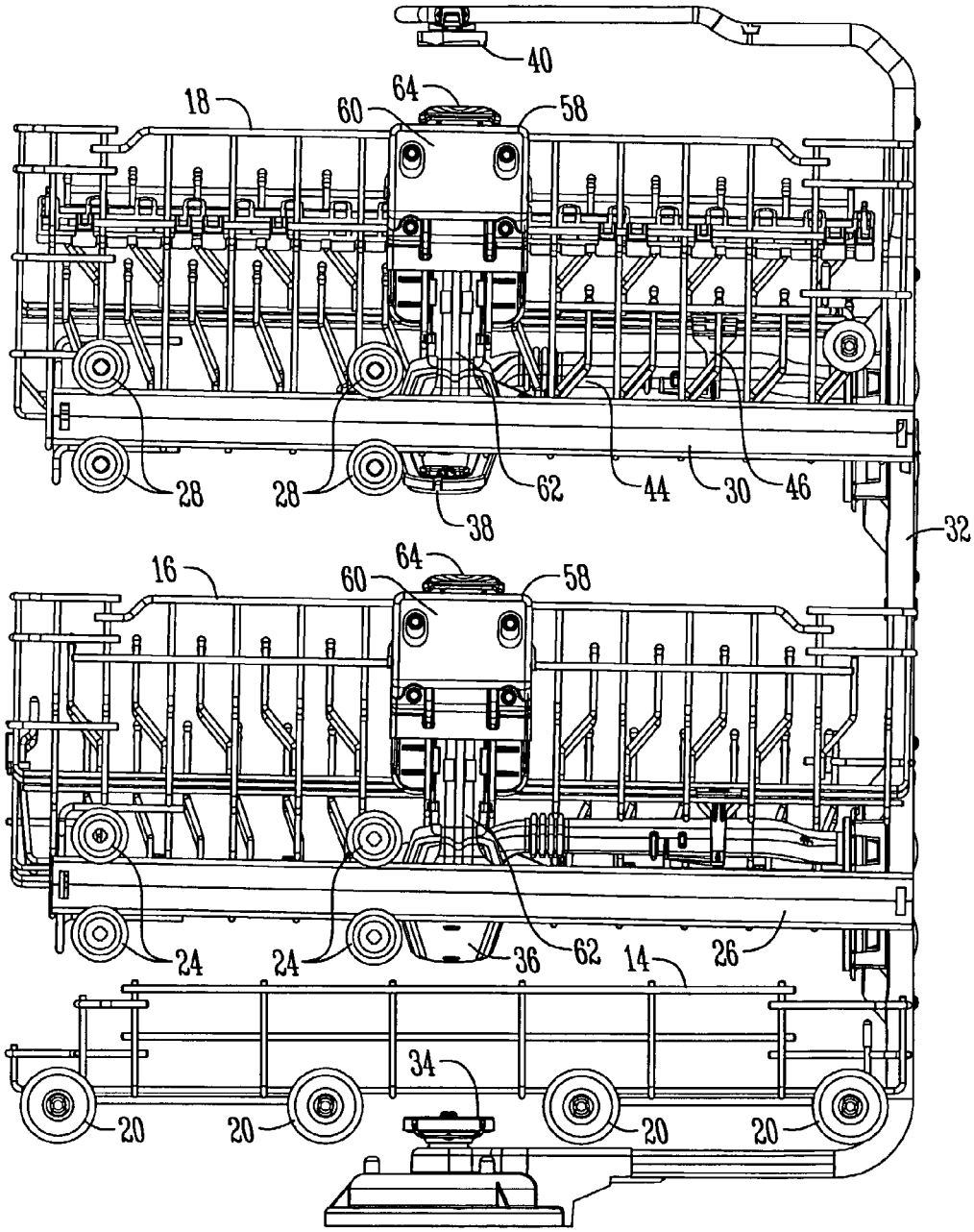
FIG. 6 is a right side elevation view of the racks and spray arms.

A water manifold 32 is operatively connected to the water pump of the dishwasher 10 and extends along the bottom and rear wall of the wash chamber 12, as best seen in FIGS. 5 and 6. A lower spray arm 34, a middle spray arm 36 and an upper spray arm 38 are fluidly connected to the water manifold 32 and are associated with the lower rack 14, middle rack 16, and upper rack 18, respectively. The lower, middle, and upper spray arms 34, 36, 38 are located beneath each rack 14, 16, 18 and are spaced in close proximity to the bottoms of the racks. A fourth spray arm 40 may also be provided above the upper rack 18. The lower spray arm 34 and the fourth spray arm 40 are fixed with respect to the water manifold 32. The middle spray arm 36 and upper spray arm 38 are fluidly connected to the water manifold 32 by wash tubes 42, 44, respectively. The wash tubes 42, 44 are connected to the middle and upper racks 16, 18, respectively, by a clip 46 (FIG. 2), and have an inner end adapted to be releasably docked within middle and upper docking ports 48 and 50 on the fluid manifold 32.

Preferably, the lower rack 14 is a flat, low profile rack without tines. Thus, the lower rack 14 is adapted to hold flat or shallow objects, such as cookie sheets, cake pans, and frying pans.

Figure 4:
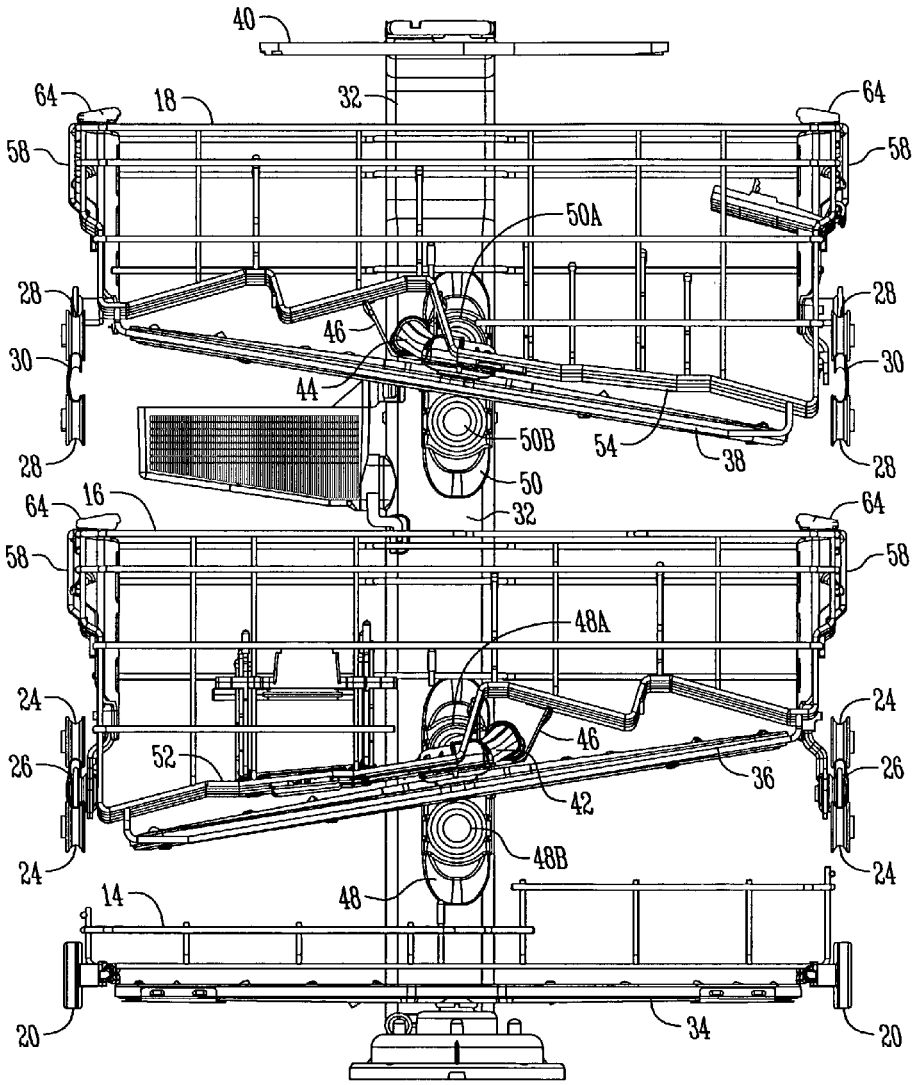
FIG. 4 is a front elevation view of the racks and spray arms.

As best shown in FIGS. 1 and 4, the middle rack 16 has a sloped or stepped bottom portion 52 that provides a tall space on the right side of wash chamber 12 between the lower rack 14 and middle rack 16. This right side tall space allows washing of taller objects on the right side of lower rack 14. Similarly, the upper rack 18 has a sloped or stepped bottom portion 54 that provides a tall space on the left side of the wash chamber 12 between the middle rack 16 and upper rack 18. The bottoms 52, 54 of the middle and upper racks 16, 18 slope in opposite directions so that each rack can hold large objects, such as dinner plates. As seen in FIG. 4, the middle spray arm 36 and upper spray arm 38 are angled or sloped so as to correspond with the slopes of the middle and upper racks 16, 18, so that the water is sprayed in close proximity to the bottom of the racks.

The middle rack 16 and upper rack 18 may be independently vertically adjusted, using conventional rack adjustment structure 58. For example, the adjustment mechanism 58 on each side of the middle and upper racks 16, 18 is shown in the drawings to include a block 60 with a bar 62 extending through the block 58 for upward and downward movement in the block 58. Buttons 64 are depressed to allow the bars 62, and thus the racks 16, 18 to be raised or lowered, as desired. Accordingly, the middle docking port 48 and the upper docking port 50 each include upper and lower female ports 48A, 48B, 50A, 50B, as best seen in FIG. 4.

Thus, the three rack dishwasher of the present invention having separate spray arms for each rack provides an efficient and effective cleaning of objects held in each rack.

Whereas the invention has been shown and described in connection with the preferred embodiment thereof, it will be understood that any modifications, substitutions, and additions may be made which are within the intended broad scope of the following claims. From the foregoing, it can be seen that the present invention accomplishes at least all of the stated objectives.

What is claimed is:

1. A dishwasher comprising:

a lower rack;

a middle rack;

an upper rack;

wherein the middle and upper racks each being rectangular and each having opposite sides with lower edges located at different elevations so as to define sloped bottoms;

a rotatable lower spray arm associated with the lower rack;

a rotatable middle spray arm associated with the middle rack; and a rotatable upper spray arm associated with the upper rack.

2. The dishwasher of claim 1 wherein the spray arms are located beneath the respective racks and are spaced in close proximity to the respective racks.

3. The dishwasher of claim 2 further comprising a fourth spray arm located above the upper rack.

4. The dishwasher of claim 1 wherein the lower rack is without tines.

5. The dishwasher of claim 1 wherein the sloped bottoms include a plurality of steps.

6. The dishwasher of claim 1 wherein the bottoms of the middle and upper racks are sloped in opposite directions.

7. The dishwasher of claim 1 wherein the middle and upper spray arms are sloped substantially similarly to the slope of the bottoms of the middle and upper racks, respectively.

8. The dishwasher of claim 1 wherein each of the middle and upper racks are vertically adjustable, independent of one another.

9. A dishwasher comprising:

a washing chamber;

a lower rack;

a middle rack;

an upper rack;

the racks each extending substantially across the washing chamber;

the middle and upper racks, each being rectangular and each having opposite sides with lower edges located at different elevations so as to define bottoms sloped in opposite directions from one another.

10. The dishwasher of claim 9 further comprising lower, middle and upper spray arms associated with the lower, middle and upper racks, respectively.

11. The dishwasher of claim 10 wherein the spray arms are located beneath the respective racks and are spaced in close proximity to the respective racks.

12. The dishwasher of claim 10 further comprising a fourth spray arm located above the upper rack.

13. The dishwasher of claim 9 wherein the lower rack is without tines.

14. The dishwasher of claim 9 wherein each of the middle and upper racks are vertically adjustable, independent of one another.

15. The dishwasher of claim 9 wherein the middle and upper spray arms are sloped substantially similarly to the slope of the bottoms of the middle and upper racks, respectively.

16. A dishwasher comprising:

a flat lower rack without tines;

a middle rack;

an upper rack, the middle and upper racks being rectangular and each having opposite sides with lower edges located at different elevations so that the racks are inclined with respect to a horizontal plane; and the upper rack being positioned over the middle rack.

17. A dishwasher of claim 16 further comprising a lower spray arm, a middle spray arm, an upper spray arm, the lower, middle and upper spray arms being associated with the lower, middle and upper racks, respectively.

18. The dishwasher of claim 17 wherein the spray arms are located beneath the respective racks and are spaced in close proximity to the respective racks.

19. The dishwasher of claim 18 wherein the middle and upper racks are inclined in opposite directions.

20. The dishwasher of claim 19 wherein the middle and upper spray arms are inclined substantially similarly to the incline of the bottoms of the middle and upper racks, respectively.

21. The dishwasher of claim 18 further comprising a fourth spray arm located above the upper rack.

22. The dishwasher of claim 16 wherein each of the middle and upper racks are vertically adjustable, independent of one another.

23. The dishwasher of claim 16 wherein the middle and upper racks have inclined portions which are stepped.

24. A dishwasher comprising:

a wash chamber;

a pair of rectangular racks positioned one above the other, and each having opposite sides with lower edges located at different elevations so as to define sloped bottoms; and the bottoms being sloped in opposite directions.

25. The dishwasher of claim 24 further comprising spray arms located beneath each of the racks, and each spray arm being sloped to match the slope of the adjacent rack bottom portion.

26. The dishwasher of claim 24 further comprising a third rack beneath the pair of racks.

27. The dishwasher of claim 24 wherein each bottom has a plurality of steps.

28. The dishwasher of claim 24 wherein the racks each extend substantially across the wash chamber.

29. The dishwasher of claim 24 wherein the racks each roll into and out of the wash chamber.

* * * * *